US005392102A

United States Patent [19]

Toyoizumi et al.

[11] Patent Number: 5,392,102

[45] Date of Patent: Feb. 21, 1995

[54] DEVELOPING DEVICE HAVING TONER CARTRIDGE DISCRIMINATOR

[75] Inventors: Yoshihiko Toyoizumi; Masahiro Yoshino, both of Hachioji, Japan

[73] Assignee: Konica Corporation, Tokyo, Japan

[21] Appl. No.: 53,594

[22] Filed: Apr. 27, 1993

[30] Foreign Application Priority Data

May 26, 1992 [JP] Japan ..... 4-158789

[51] Int. Cl.[6] ..... G03G 15/08

[52] U.S. Cl. ..... 355/245; 355/260; 355/326

[58] Field of Search ..... 355/205, 206, 209, 245, 355/260, 326

[56] References Cited

U.S. PATENT DOCUMENTS 4,611,899 9/1986 Kasamura et al. ..... 355/260
4,963,939 10/1990 Kurando et al. ..... 355/260
5,208,631 5/1993 Jacobs et al. ..... 355/260 X

FOREIGN PATENT DOCUMENTS 0173482 7/1987 Japan ..... 355/260
0003683 1/1989 Japan .
0091669 3/1990 Japan ..... 355/260
0267965 11/1991 Japan ..... 355/260
0001682 1/1992 Japan .
0062564 2/1992 Japan ..... 355/260

*Primary Examiner*—A. T. Grimley
*Assistant Examiner*—Robert Beatty
*Attorney, Agent, or Firm*—Bierman & Muserlian; Jordan B. Bierman

[57] ABSTRACT

An image-forming apparatus includes a developer container containing a developer which is to be inserted into a developer replenisher of a main body, a cover for the developer replenisher and a cover for the developer container. The cover for the developer replenisher and the cover for the developer container are capable of being opened when the developer container is attached to the main body. The image-forming apparatus has a discriminator for discriminating whether the inserted developer container is identified with the developer replenisher. The cover for the developer replenisher and the cover for the developer container are to be opened only when the inserted developer container is identified.

7 Claims, 18 Drawing Sheets

DEVELOPING DEVICE HAVING TONER CARTRIDGE DISCRIMINATOR

FIELD OF THE INVENTION

This invention relates to image-forming apparatuses such as electrophotographic copying machines and laser printers and, particularly, to image-forming apparatuses to which a developer is supplied from a developer container.

BACKGROUND OF THE INVENTION

Generally, common black developers have been heretofore used widely in image-forming apparatuses such as electrophotographic copying machines and laser printers. In recent years, however, compact sized image-forming apparatuses for personal use have been popularized and the users' application has been widened, so that not only black-color images but also the other color images and multicolor-images superimposed with different colors thereon have been very often used.

Because the developers are consumed by making use of the above-mentioned image-forming apparatus, the developers are to be replenished. The replenishments are generally carried out in the following manner. A developer container containing a developer is inserted into a developer replenisher of the main body of the apparatus and the cover for the developer replenisher and the cover for the developer container are opened and closed in the inserted state, so that the developer inside the developer container may be replenished from the developer replenisher.

In such an image-forming apparatus as mentioned above, however, when trying to replenish a certain color developer from a developer container containing the same color developer into a developing section and if erroneously replenishing some different color developer from a developer container containing the different color developer, there may be a possibility of making the apparatus unusable at all until the developing section is overhauled to be cleaned up.

Therefore, as disclosed each in Japanese Patent Publication Open to Public Inspection (hereinafter abbreviated to JP OPI Publication) Nos. 3-267965/1991 and 3-269461/1991, there are some apparatuses in which it is made impossible to insert any developer container containing different color developer into a developer replenisher of the main apparatus body, except that only a specific developer container can be inserted therein, so that the replenishments can be made only from a developer container containing the same color developer.

Even in an apparatus in which a specific developer container only can be inserted into the developer replenisher of the main apparatus body and if even a portion of the developer container containing a different color developer is inserted askew into the developer replenisher of the main apparatus body, there may be some instances where the cover for the developer replenisher may be opened by coupling it to the developer container of the main apparatus body, in the above-mentioned state. Therefore, a different kind of developer may sometimes be erroneously replenished from a developer replenisher of the main apparatus body or a trouble may be produced to make the developer adhere to the surroundings of the developer replenisher of the main apparatus body.

When a replenishment is carried out by an average user, he cannot discriminate whether the method of inserting a developer container is wrong or not and whether a wrong developer container is inserted or not. Therefore, not only does it takes a long time to replenish a developer, but also there is a possibility of damaging the developer container because he tries to forcibly insert the developer container containing a different kind of developer.

This invention has been achieved by taking the actual state of things into consideration. It is therefore an object of the invention to provide a simple-structured and easy-handling image-forming apparatus capable of preventing any replenishments of different color developers safely without damaging any developer container.

SUMMARY OF THE INVENTION

In order to solve the above-mentioned problems, when inserting a developer container into a developer replenisher, the inserted developer container is discriminated as to whether it is the specified one or not and, only when the inserted developer container is the specified one, can the cover for the developer replenisher and a cover for the specified developer container be opened and closed.

An image-forming apparatus wherein the developer container containing a developer is inserted into the developer replenisher of a main body of the apparatus and the cover for the developer replenisher and the cover for the developer container are opened and closed in the inserted state, so that the developer inside the developer container can be replenished from the developer replenisher; the above-mentioned image-forming apparatus is characterized in that: a discriminating means is provided so as to discriminate whether the inserted developer container is the specified one or not and the cover for the developer replenisher and the cover for the developer container are so constructed as to be opened and closed only when the inserted developer container is the specified one.

The cover for the developer replenisher and the cover for the developer container are opened and closed interlockingly in the inserted state.

The specified developer container is discriminated by a mechanical means operated by inserting the developer container into the developer replenisher and thereby the cover for the developer replenisher and the cover for the developer container can be opened and closed.

The image-forming apparatus of the invention is characterized in that: the specified developer container is discriminated by a mechanical means operated by inserting the developer container into the developer replenisher and the cover for the developer replenisher and the cover for the developer container can be opened and closed.

The developer container is discriminated as to whether it is the specified one or not by a discriminating means applied with a discriminator of the developer container and, when the developer container is discriminated as being the specified one, the controls of the control means are released so that both covers for the developer container and for the developer replenisher can be opened and closed.

The image-forming apparatus of the invention is characterized in that: a discriminator is provided to discriminate whether the developer container is the specified one or not and a control means is provided so that, when the developer container is discriminated as being the specified one by the discriminating means provided with the discriminator, both covers for the developer container and the developer replenisher can be opened and closed by releasing the control of the discriminator provided to discriminate whether the developer container is the specified one or not and a control means is provided so that, when the developer container is discriminated as being the specified one by the discriminating means provided with the discriminator, both covers for the developer container and the developer replenisher can be opened and closed by releasing the control.

The specified developer container is discriminated by an electric means operable when the developer container is inserted into the developer replenisher, so that the cover for the developer replenisher and the cover for the developer container can be opened and closed.

The image-forming apparatus of the invention is characterized in that: the specified developer container is discriminated by an electric means operable when the developer container is inserted into the developer replenisher and thereby the cover for the developer replenisher and the cover for the developer container can be opened and closed.

Discriminated information is read out of the discrimination information section of the developer container by a sensor provided to the developer replenisher, and thereby the developer container is discriminated, so that the cover for the developer replenisher and the cover for the specified developer container can be opened and closed.

The image-forming apparatus is characterized in that: a discrimination information section is provided to the developer container and, at the same time, a sensor for reading the discrimination information given from the discrimination information section is provided to the developer replenisher, so that the cover for the developer replenisher and the cover for the developer container can be opened and closed according to the discrimination made by the sensor.

BRIEF DESCRIPTION OF THE DRAWINGS

FIG. 12 is a cross-sectional view showing the state where the same developer container is loaded on;

FIG. 13 is a cross-sectional view showing the state where a different developer container is loaded on;

FIG. 19 is a cross-sectional view showing the state where the same developer container is loaded on;

FIG. 20 is a cross-sectional view showing the state where a different developer container is loaded on;

FIG. 24 is a cross-sectional view showing the structure of a developer replenisher of the main body of an apparatus in the state where a developer container is inserted in.

DETAILED DESCRIPTION OF THE INVENTION

Figure 1:
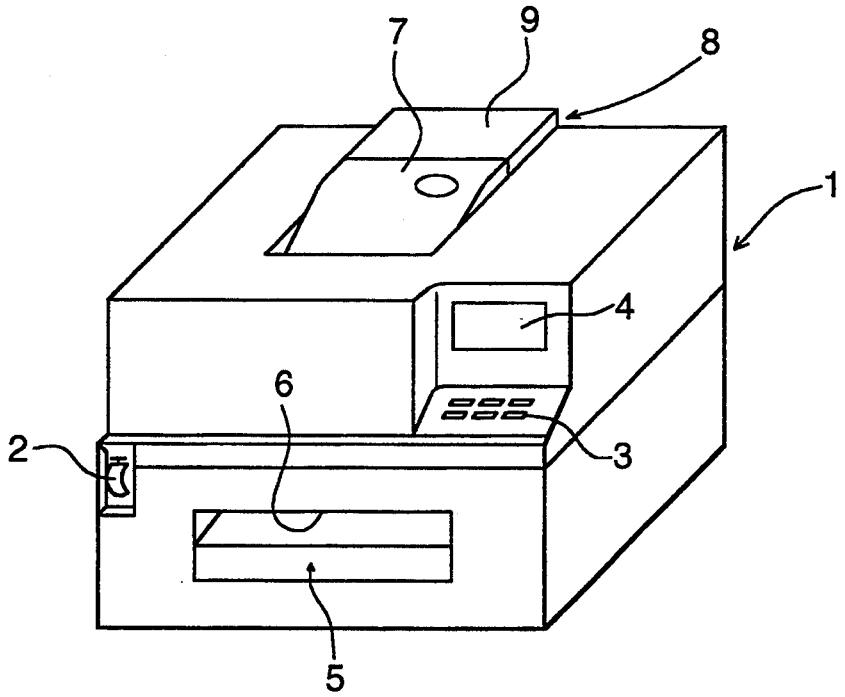
FIG. 1 is a perspective view of an image-forming apparatus seen from the front.
Figure 2:
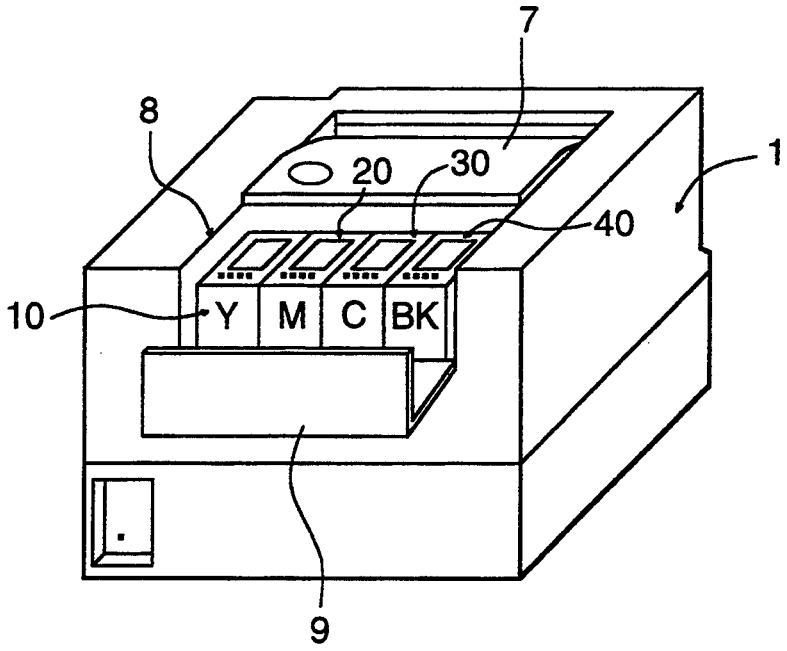
FIG. 2 is a perspective view of an image-forming apparatus seen from the back.
Figure 3:
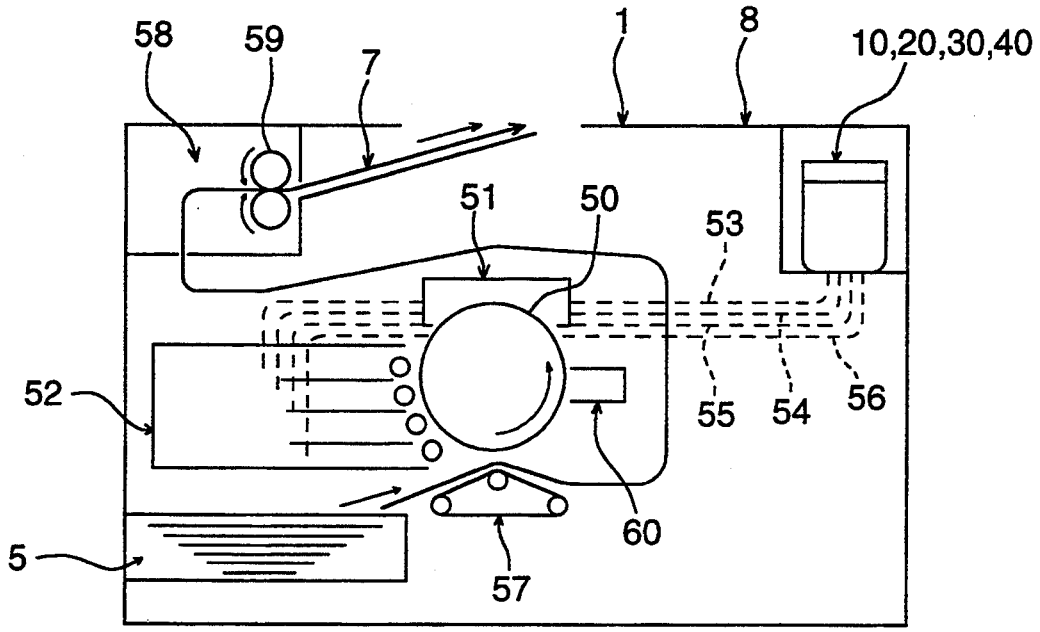
FIG. 3 is a schematic illustration showing an image-forming apparatus.

Now, the examples of the image-forming apparatuses of the invention will be detailed with reference to the drawings attached hereto. FIG. 1 is a perspective view of an image-forming apparatus seen from the front; FIG. 2 is a perspective view of the image-forming apparatus seen from the back; and FIG. 3 is a schematic illustration of the structure of the image-forming apparatus.

Image-forming apparatus 1 was provided with electric power switch 2 to the left side of the front, operation unit 3 and display 4 to the upper right side of the front and aperture 6 for setting paper-feeding unit 5 containing recording paper to the center of the front, respectively. Recorded paper takeout section 7 for taking out recorded paper was also provided to the center of the upper side of image-forming apparatus 1 and developer replenisher 8 for replenishing a developer was further provided to the back side of recorded paper takeout section 7. When cover 9 for developer replenisher 8 was opened backward, yellow developer reservoir 10, magenta developer reservoir 20, cyan developer reservoir 30 and black developer reservoir 40 could be replenished thereto with the corresponding color developers, respectively.

Photoreceptor 50 rotatable to the direction of the arrow was provided to the inside of image-forming apparatus 1. First, photoreceptor 50 was uniformly charged by charging-exposure section 51 as it was rotated and next it was then exposed to an optical image subject to a copy development from a digital image information. In the above-mentioned manner, an electrostatic latent image corresponding to the development can be formed on photoreceptor 50.

The resulting electrostatic latent image was developed in yellow, magenta, cyan and black at developing section 52, so that a toner image could be formed. To developing section 52, yellow developer reservoir 10, magenta developer reservoir 20, cyan developer reservoir 30 and black developer reservoir 40 were connected through replenishing pipes 53~56, so that the same color developers could be replenished from developer replenisher 8 of the main apparatus body, respectively.

Next, the resulting toner image is transferred to a recording paper under the function of transfer-charging unit 57. The recording paper sheets were fed one after another out of paper feeding unit 5 and the toner image was then transferred under the function of transfer-charging unit 57. After completing the transfer, the recorded paper was separated from photoreceptor 50 and then sent to fixing unit 58, so that toner was fused into the recorded paper, and thereby the image was fixed onto the recorded paper. After completing the fixation, the sheet having the fixed image is ejected from the apparatus by ejection rollers 59, the toner remaining on photoreceptor 50 was cleaned up by cleaning unit 60 and photoreceptor 50 was ready to be used again in the above-mentioned image-forming process.

Now, the image-forming apparatus will be detailed below.

Figure 4:
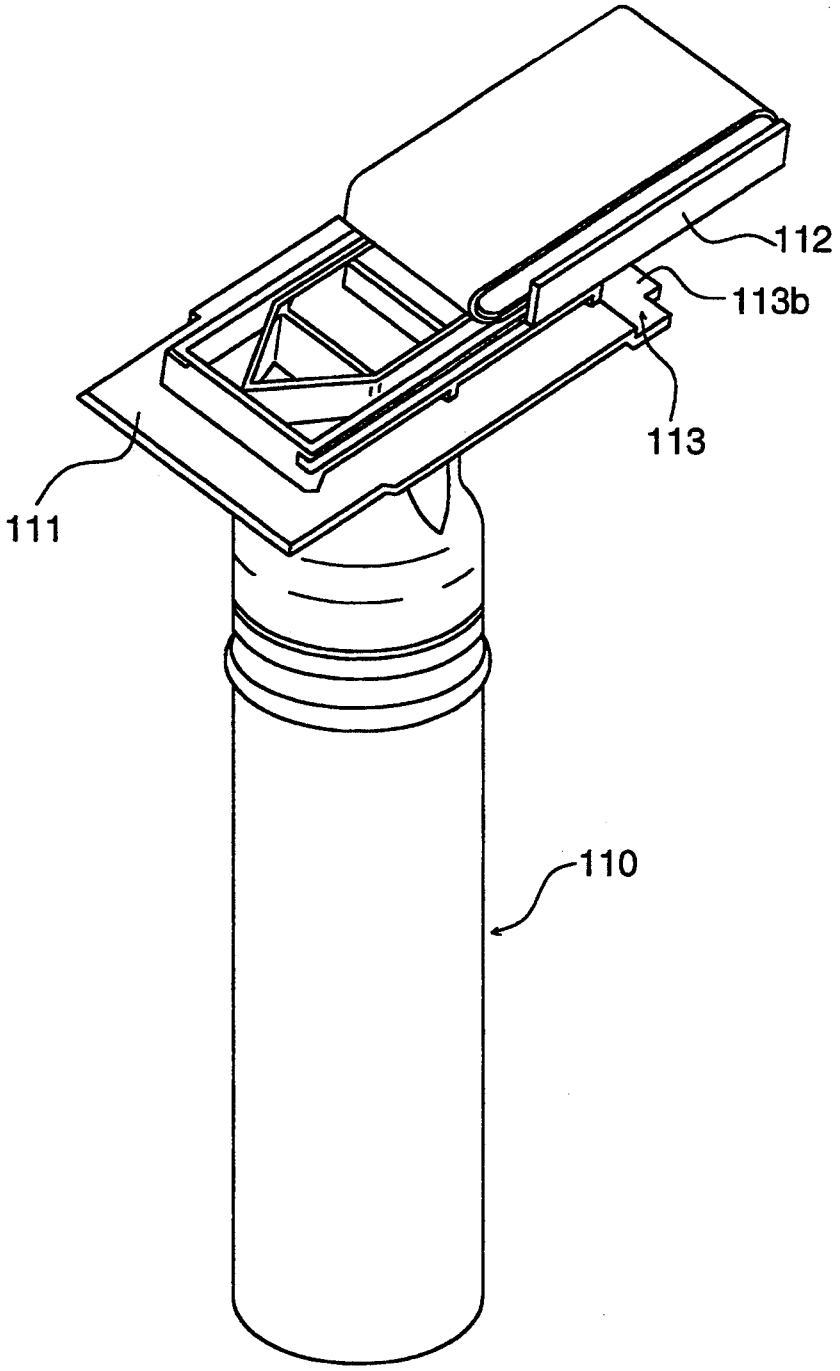
FIG. 4 is a perspective view of a yellow developer container.
Figure 5:
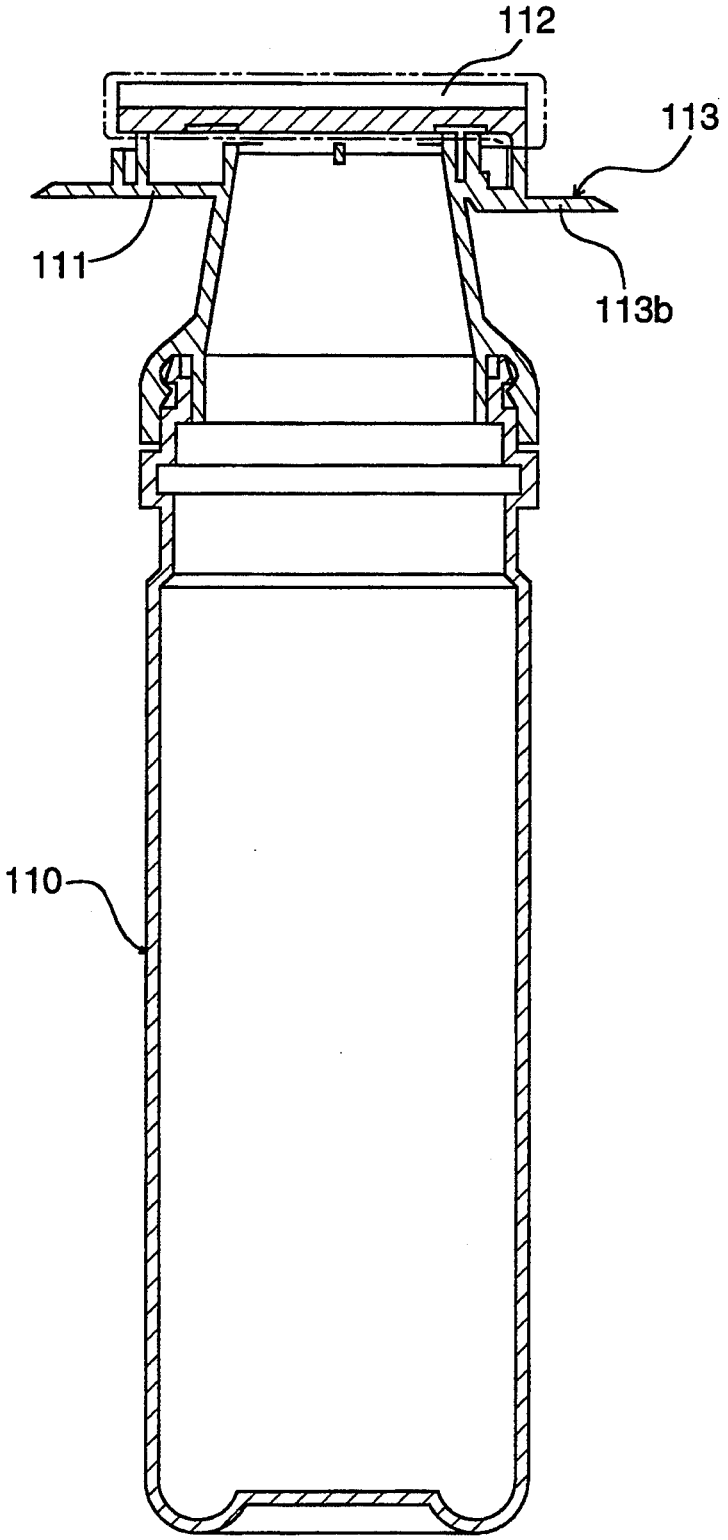
FIG. 5 is a cross-sectional view of a yellow developer container.
Figure 6:
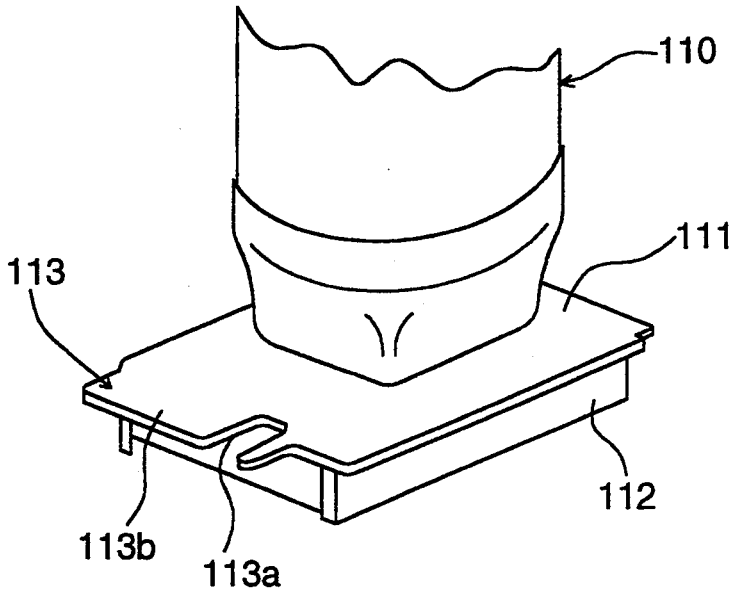
FIG. 6 is a perspective view of a part of a yellow developer container.

About the developer container that was inserted into the developer replenisher of the main apparatus body of the image-forming apparatus, the description thereof will be made below. FIG. 4 is a perspective view of a yellow developer container, FIG. 5 is a cross-sectional view of the yellow developer container, and FIG. 6 is a perspective view of a part of the yellow developer container.

In yellow developer container 110, a developer was contained. To supply section 111 of the above-mentioned yellow developer container 110, slidable cover 112 was provided. To supply section 111, discriminating section 113 corresponding to the color of a developer was provided. The above-mentioned discriminating section 113 was comprised of plate portion **113*b* having notched portion 113*a* provided to the end of supply section 111**.

Figure 7:
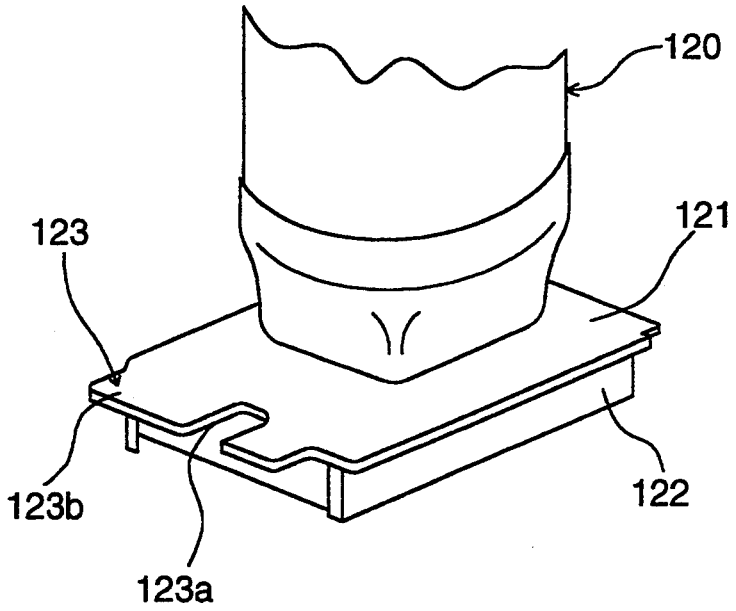
FIG. 7 is a perspective view of a part of a magenta developer container.

FIG. 7 is a perspective view of a part of a magenta developer container. To supply section 121 of magenta developer container 120, slidable cover 122 was similarly provided. To supply section 121, discriminator 123 corresponding to the color of a developer was also provided. To plate portion **123*b* constituting the above-mentioned discriminator 123, notched portion 123*a*** was provided to a position different from the above-mentioned position.

Figure 8:
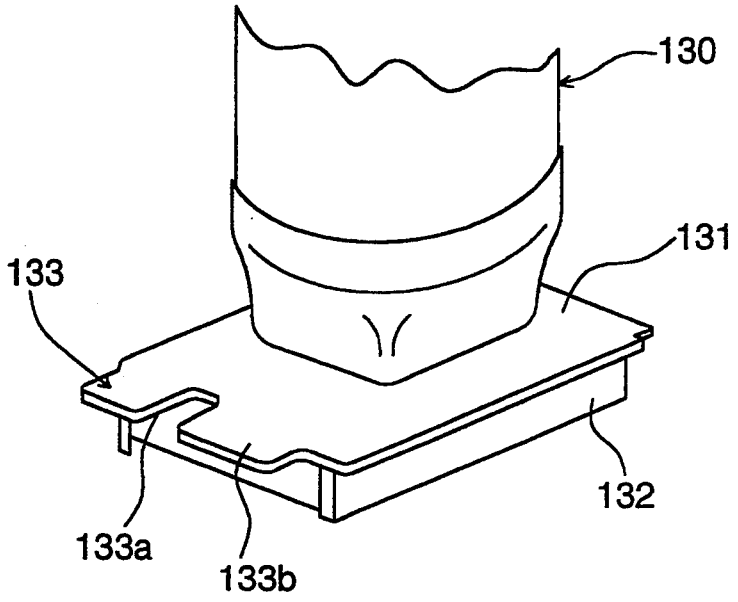
FIG. 8 is a perspective view of a part of a cyan developer container.

FIG. 8 is a perspective view of a part of a cyan developer container. To supply section 131 of cyan developer container 130, slidable cover 132 was similarly provided. To supply section 131, discriminator 133 corresponding to the color of a developer was also provided. To plate portion **133*b* constituting discriminator 133, notched portion 133*a*** was provided to a position different from the above-mentioned position.

Figure 9:
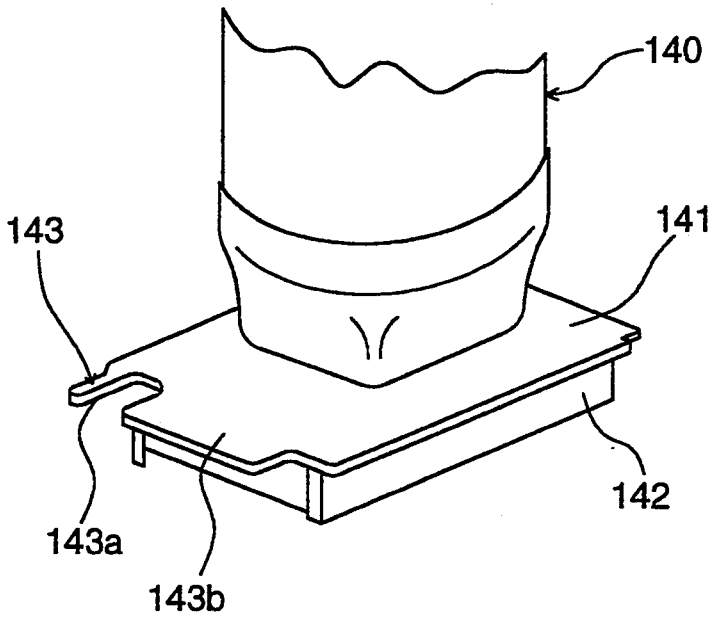
FIG. 9 is a perspective view of a part of a black developer container.

FIG. 9 is a perspective view of a part of a black developer container. To supply section 141 of black developer container 140, slidable cover 142 was similarly provided. To supply section 141, discriminator 143 corresponding to the color of a developer was also provided. To plate portion **143*b* constituting the above-mentioned discriminator 143, notched portion 143*a*** was further provided to a position different from the above-mentioned position.

As described above, yellow developer container 110, magenta developer container 120, cyan developer container 130 and black developer container 140 were as same as in the constitution, only except that the constitution of discriminators 113, 123, 133 and 143 each corresponding to the colors of developers. The production costs were reduced by making the constitution be in common.

Figure 10:
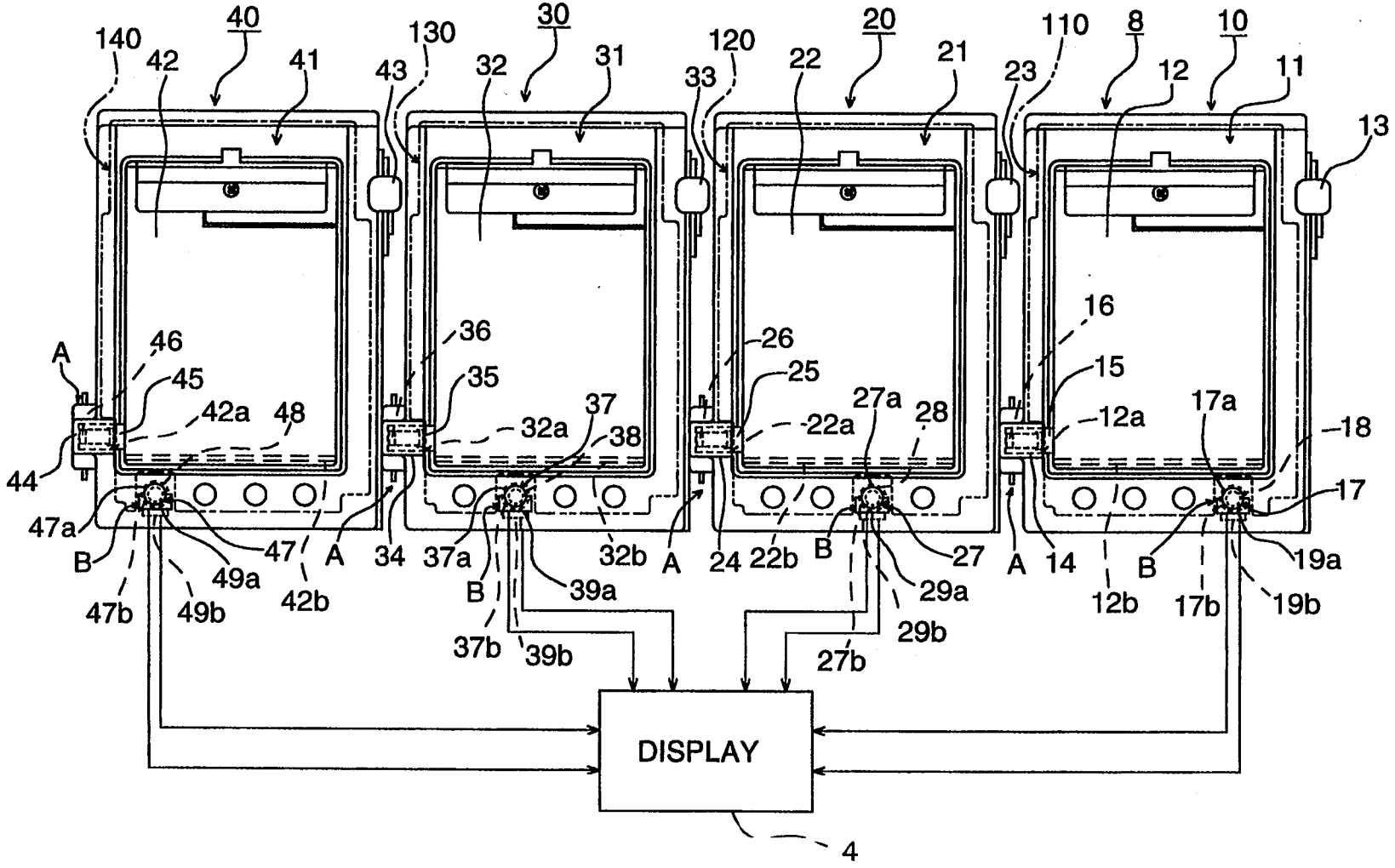
FIG. 10 is a top-plan view of a developer replenisher of a development unit.
Figure 11:
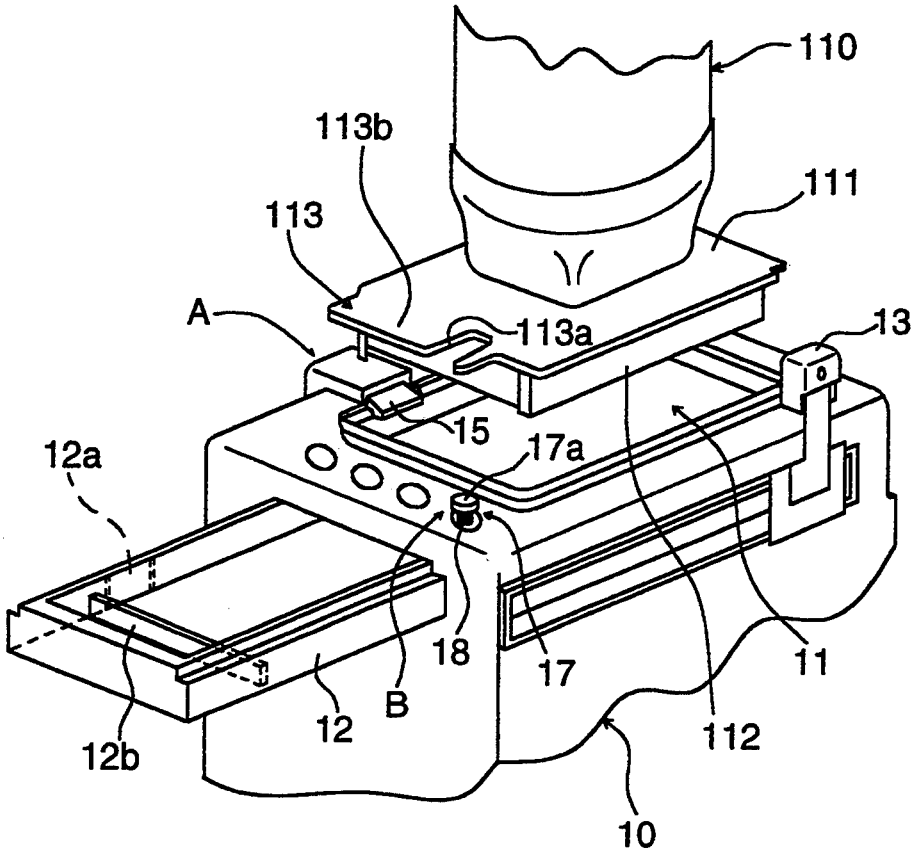
FIG. 11 is a perspective view showing the insertion of a developer container into a developer replenisher of a development unit.
Figure 12:
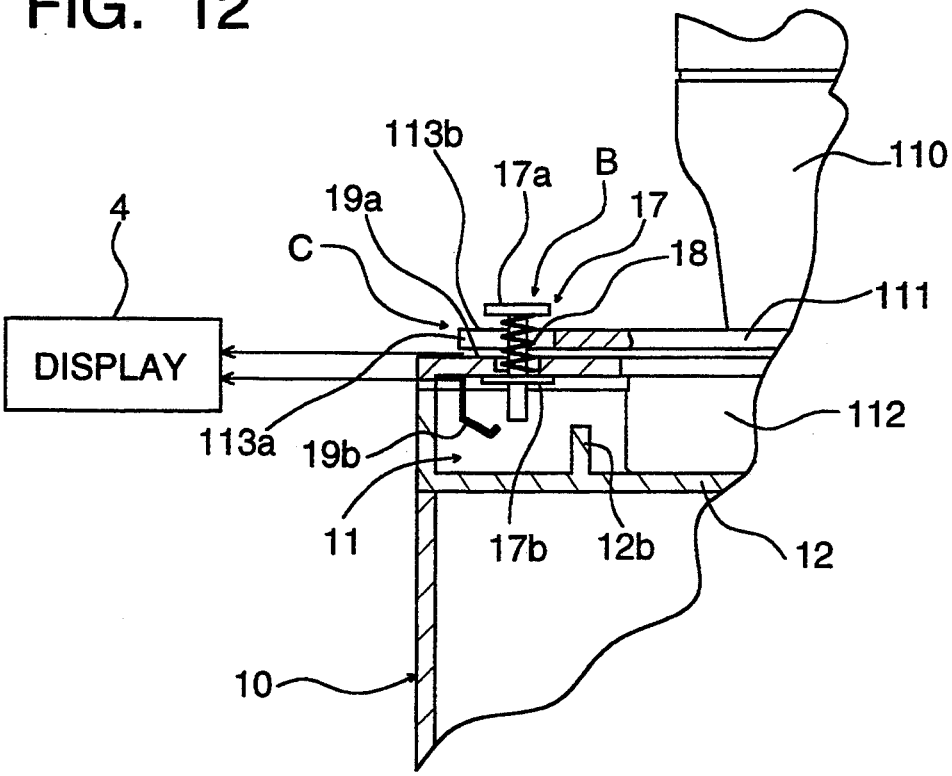
Figure 13:
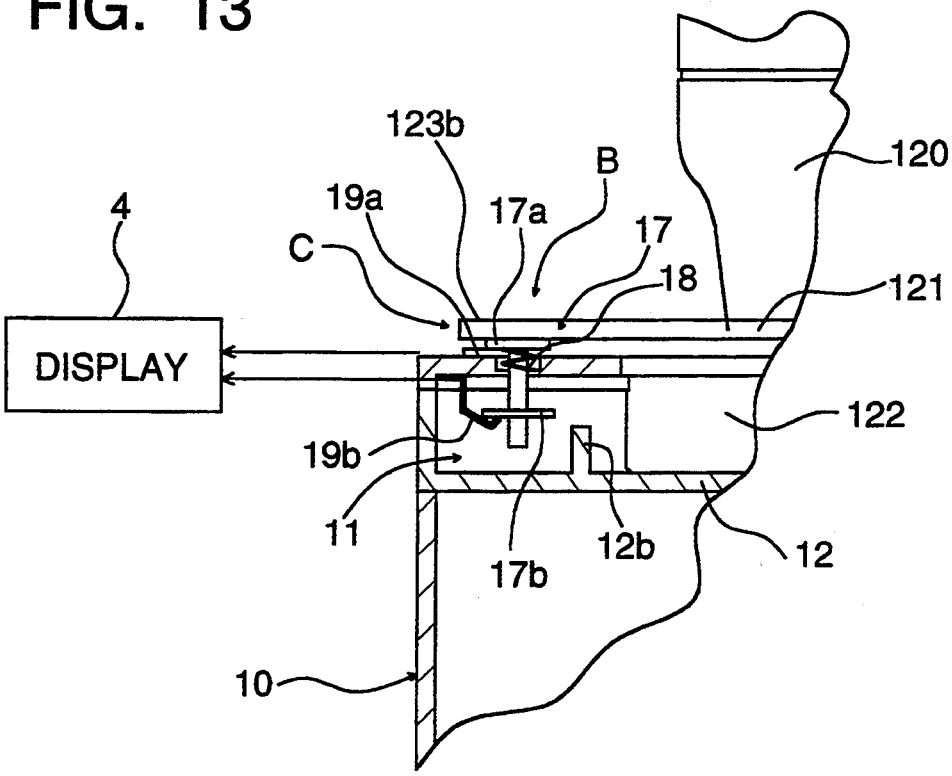

Next, the image-forming apparatus will be detailed below. FIG. 10 is a top-plan view of the developer replenisher of an image-forming apparatus. FIG. 11 is a perspective view showing the insertion of a developer container into the developer replenisher of an image-forming apparatus. FIG. 12 is a cross-sectional view showing the state where the same developer container was inserted therein. FIG. 13 is a cross-sectional view showing the state where a different developer container was inserted therein.

In the main body of the image-forming apparatus, developer replenisher 8 was arranged with yellow, magenta, cyan and black developer reservoirs 10, 20, 30, 40, respectively. Developer supply sections 111, 121, 131, 141 of yellow, magenta, cyan and black developer containers 110, 120, 130, 140 were so provided as to be inserted into replenishing apertures 11, 21, 31, 41 of developer reservoirs 10, 20, 30, 40, respectively. Covers 12, 22, 32, 42 were so provided as to be slidable to replenishing apertures 11, 21, 31, 41, respectively. The covers 12, 22, 32, 42 were provided with knobs 13, 23, 33, 43, respectively. Covers 12, 22, 32, 42 were opened and closed by operating knobs 13, 23, 33, 43 by hand, respectively.

Covers 12, 22, 32, 42 were usually arranged to cover replenishing apertures 11, 21, 31, 41 so as to prevent incoming dust from replenishing apertures 11, 21, 31, 41 or to prevent any other developers from mixing-in when replenishing a developer. When inserting developer supply sections 111, 121, 131, 141 of yellow, magenta, cyan and black developer containers 110, 120, 130 140, then, covers 12, 22, 32, 42 were coupled interlockwise to covers 112, 122, 132, 142 of developer supply sections 111, 121, 131, 141 to be opened and closed, respectively.

To the side of each of replenishing apertures 11, 21, 31, 41, boxes 14, 24, 34, 44 were provided. To boxes 14, 24, 34, 44, locking members 15, 25, 35, 45 were so provided as to be movable to the directions of covers 12, 22, 32, 42, respectively. Locking members 15, 25, 35, 45 were elastically energized by leaf-springs 16, 26, 36, 46 so that they could be coupled to hollows **12*a*, 22*a*, 32*a*, 42*a* provided to the inside of covers 12, 22, 32, 42, respectively. When inserting yellow, magenta, cyan and black developer containers 110, 120, 130, 140 into replenishing apertures 11, 21, 31, 41, then, locking members 15, 25, 35, 45 were each moved against the elasticity of leaf-springs 16, 26, 36, 46, so that the coupling of covers 12, 22, 32, 42 to hollows 12*a*, 22*a*, 32*a*, 42*a* could be released to make covers 12, 22, 32, 42 slidable. In the above-described manner, Control means A was so constituted as to release the control when inserting the supply sections of developer containers into replenishing apertures 11, 21, 31, 41 and to make covers 12, 22, 32, 42** slidable.

To replenishing apertures 11, 21, 31, 41, metal-made stopper pins 17, 27, 37, 47 were provided, respectively. Stopper pins 17, 27, 37, 47 were so positioned as to face notches **113*a*, 123*a*, 133*a*, 143*a* of discriminators 113, 123, 133, 143 corresponding to the colors of developers contained in yellow, magenta, cyan and black developer containers 110, 120, 130, 140**, respectively.

Stopper pins 17, 27, 37, 47 were provided with heads 17a, 27a, 37a, 47a and collars 17b, 27b, 37b, 47b, respectively. Springs 18, 28, 38, 48 were provided between heads 17a, 27a, 37a, 47a and the upper surfaces of replenishing apertures 11, 21, 31, 41, so that stopper pins 17, 27, 37, 47 could be elastically energized upward constantly.

Therefore, as shown in FIG. 12, when correctly inserting yellow, magenta, cyan and black developer containers 110, 120, 130, 140, stopper pins 17, 27, 37, 47 were not pushed downward against springs 18~48, because stopper pins 17, 27, 37, 47 and notches 113a, 123a, 133a, 143a of yellow, magenta, cyan and black developer containers 110, 120, 130, 140 were so positioned as to face to each other, respectively. Therefore, stopper walls 12b, 22b, 32b, 42b of covers 12~42 were not hit against stopper pins 17, 27, 37, 47, so that covers 12, 22, 32, 42 could be slidable, respectively.

On the other hand, as shown in FIG. 13, if yellow, magenta, cyan and black developer containers 110, 120, 130, 140 were erroneously inserted in, then, stopper pins 17, 27, 37, 47 were pushed downward against the elasticity of springs 18~48 in plate positions 113b, 123b, 133b, 143b of discriminators 113, 123, 133, 143 corresponding to the colors of developers, respectively. Therefore, stopper walls 12b, 22b, 32b, 42b of covers 12~42 were so positioned as to be hit against the pins, so that the sliding of covers 12, 22, 32, 42 could be controlled.

In the above-described manner, discriminating means B for discriminating whether the inserted developer container was specific one or not was constituted. Accordingly, the covers for developer replenishers and the covers for specific developer containers could be opened and closed only when the inserted developer containers were specific ones, respectively.

Discriminating means B shall not be limited to the above-described discriminating means B, but shall include any one of those, provided that a developer container is allowed to be inserted into a developer replenisher and that the inserted developer container can be discriminated whether it is specific one or not.

Each of the upper surface of replenishing apertures 11, 21, 31, 41 was provided with contact piece 19a constantly coming into contact with stopper pins 17, 27, 37, 47. The inside of replenishing apertures 11, 21, 31, 41 were provided with contact pieces 19b, 29b, 39b, 49b to come into contacted with collars 17b, 27b, 37b, 47b of the stopper pins when stopper pins 17, 27, 37, 47 were pushed to be moved, respectively. When contact pieces 19a, 29a, 39a, 49a were electrified to contact pieces 19b, 29b, 39b, 49b, respectively, an erroneous insertion was displayed on display 4.

Therefore, supply sections 111, 121, 131, 141 of yellow, magenta, cyan and black developer containers 110, 120, 130, 140 were inserted into replenishing apertures 11, 21, 31, 41 of yellow, magenta, cyan and black developer reservoirs 10, 20, 30, 40, respectively. However, if a developer container containing any different developer was erroneously inserted, such an erroneous insertion can easily be confirmed visually, because a stopper pin was pushed to be moved by the discriminator of the corresponding developer container. In addition, when the supply sections of the developer containers were inserted into developer replenishers, the control of the cover for the developer replenishers, which was controlled by control means A, was so released as to be slidable. However, the sliding of the covers for the developer reservoirs were controlled. Therefore, the replenishments of any different color developers were prevented.

When a developer container containing the same color developer was inserted, stopper pins were not operable by the insertion at the discriminator of the developer container. Therefore, the cover for the developer reservoir became slidable and the same color developer could be replenished to the developer reservoir.

Yellow, magenta, cyan and black developer reservoirs 10, 20, 30, 40 were each made of plastics and built into one body. In this case, the reservoirs were allowed to be processed by changing the positions of the stopper pins later on, so that the molding dies could be used in common so as to reduce the production costs.

Now, another example of image-forming apparatuses will be detailed below.

Figure 14:
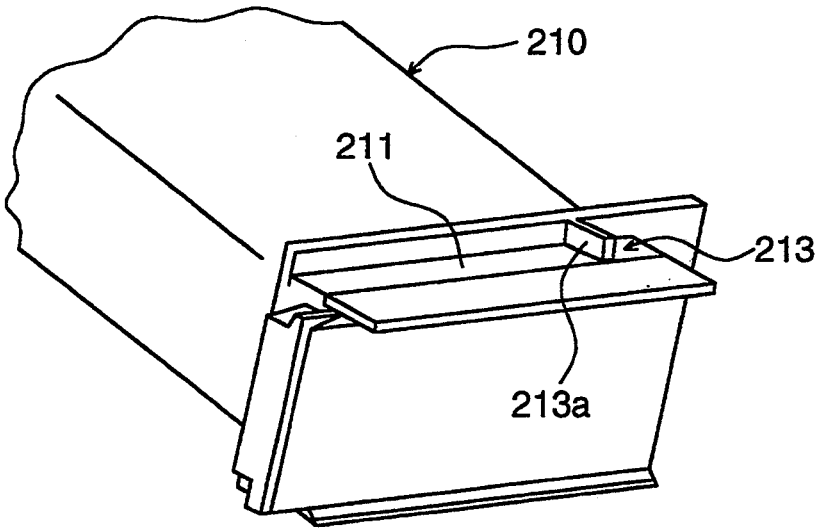
FIG. 14 is a perspective view of a part of a yellow developer container.
Figure 15:
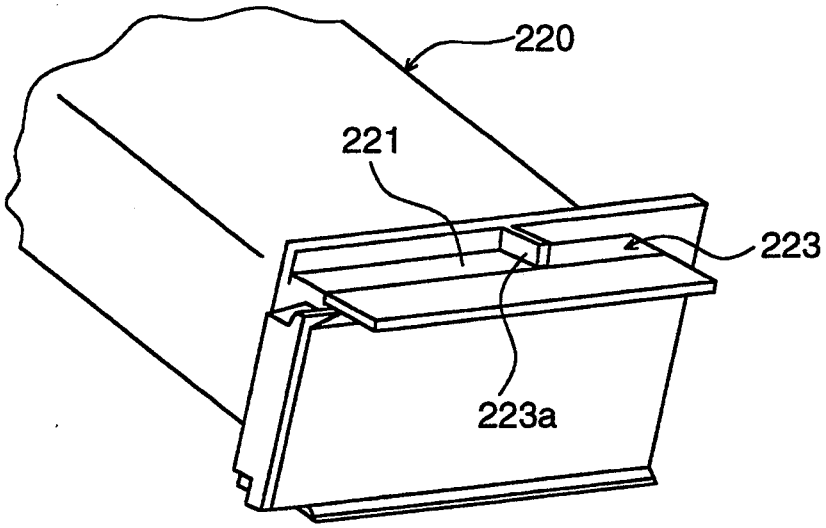
FIG. 15 is a perspective view of a part of a magenta developer container.
Figure 16:
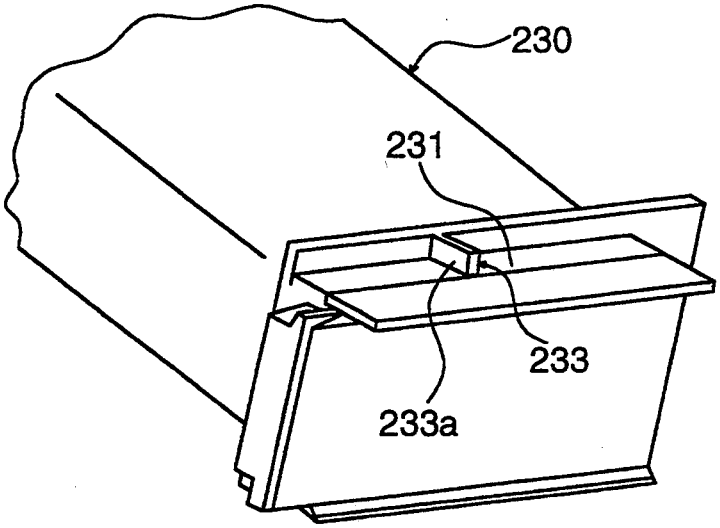
FIG. 16 is a perspective view of a part of a cyan developer container.
Figure 17:
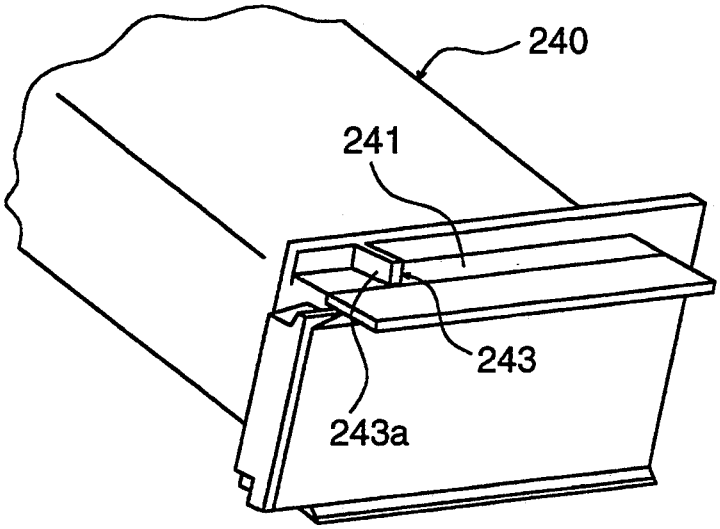
FIG. 17 is a perspective view of a part of a black developer container.

First, the description will be made about a developer container for replenishing a developer to a developer replenisher of the main body of an image-forming apparatus. FIG. 14 is a perspective view of a part of a yellow developer container. FIG. 15 is a perspective view of a part of a magenta developer container. FIG. 16 is a perspective view of a part of a cyan developer container. And, FIG. 17 is a perspective view of a part of a black developer container.

To supply sections 211, 221, 231, 241 of yellow, magenta, cyan and black developer containers 210, 220, 230, 240, discriminators 213, 223, 233, 243 corresponding to the colors of developers were provided, respectively. These discriminators 213, 223, 233, 243 were formed of protrusions 213a, 223a, 233a, and 243a each formed to the different positions, respectively.

Figure 18:
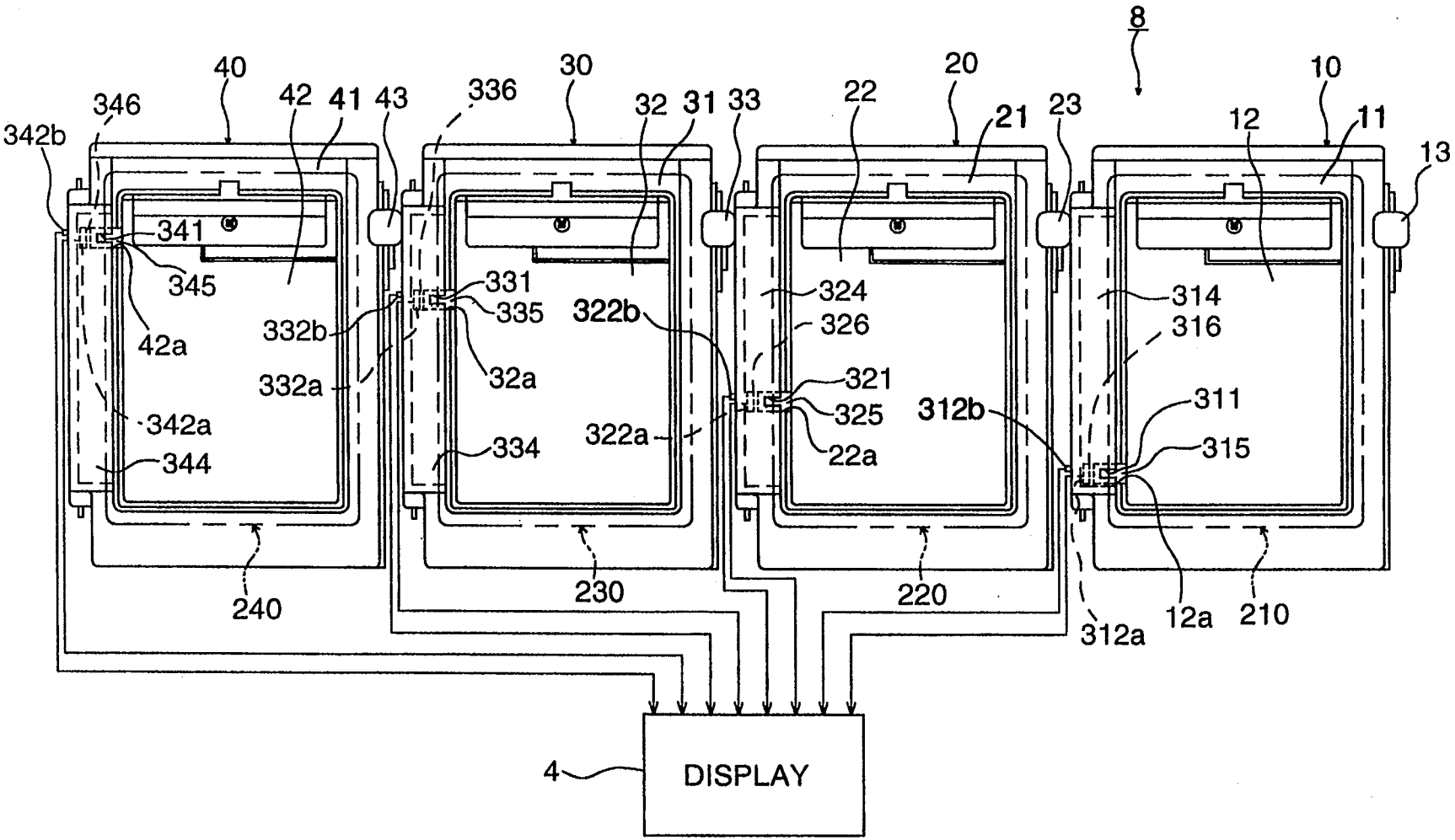
FIG. 18 is a top-plan view of a developer replenisher of a development unit.
Figure 19:
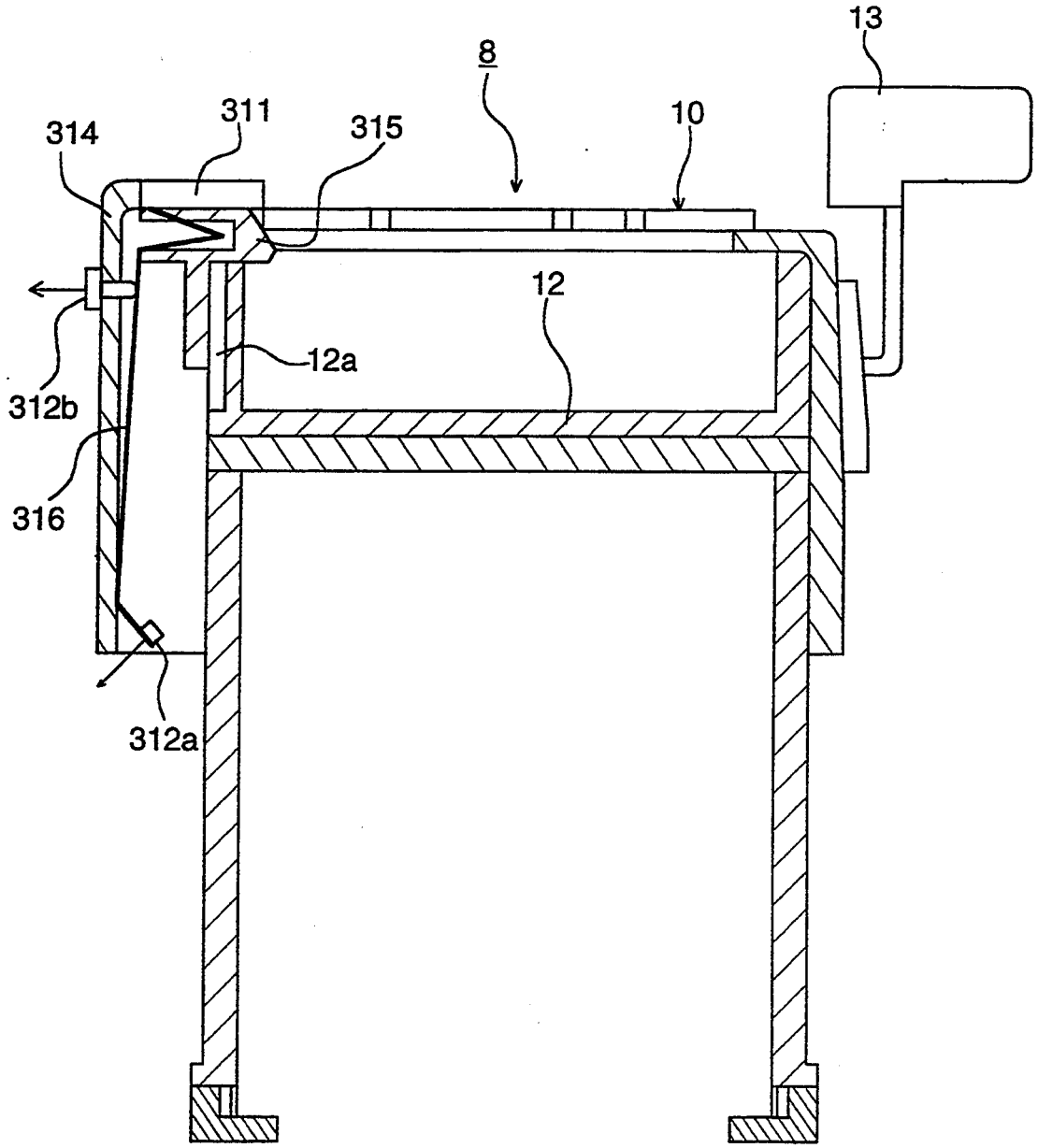
Figure 20:
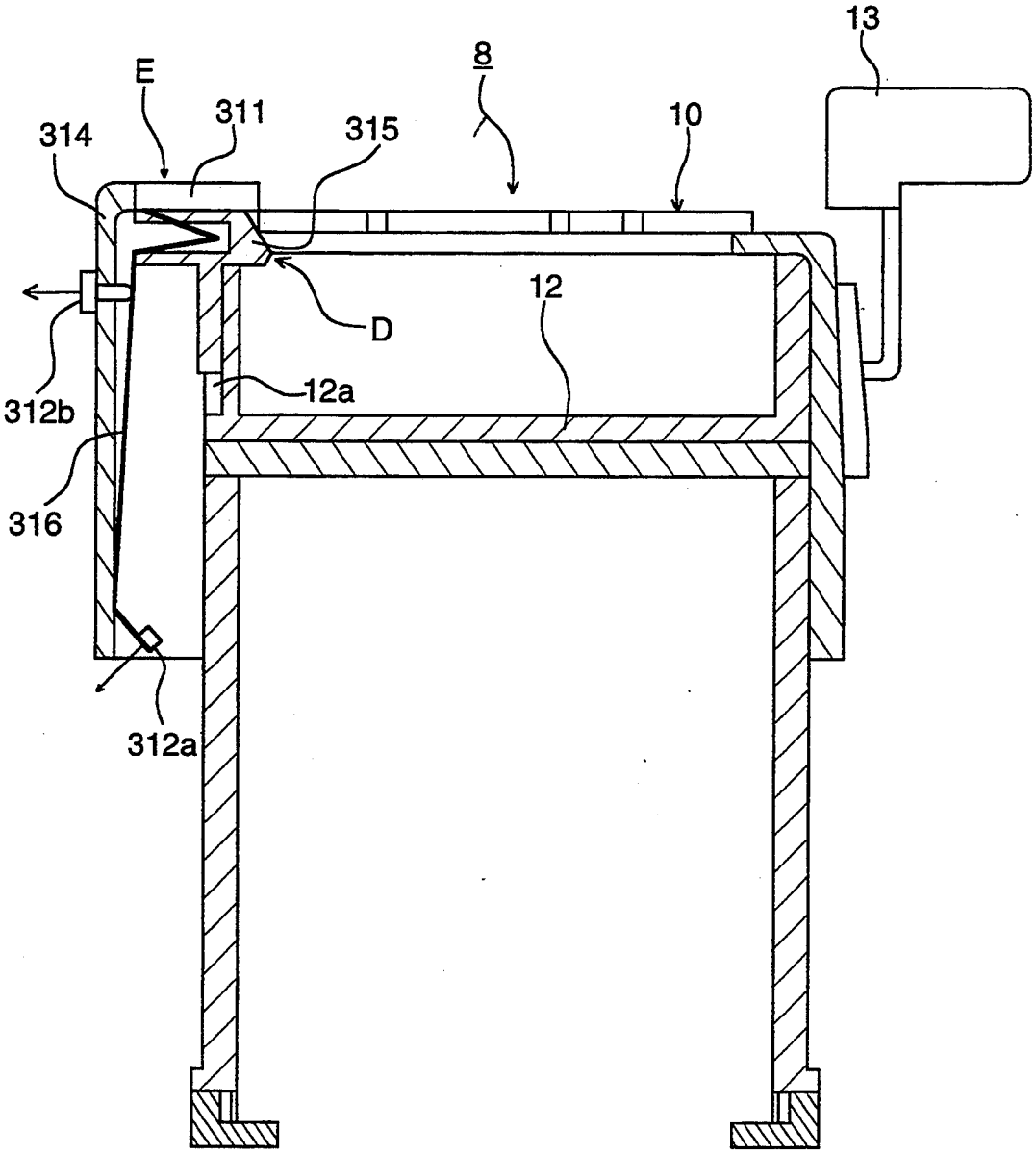

Next, the image-forming apparatus will be detailed. FIG. 18 is a top-plan view of the developer replenisher of the main body of the image-forming apparatus. FIG. 19 is a cross-sectional view of the same developer container in the inserted state. And, FIG. 20 is a cross-sectional view of a different developer container in the inserted state.

To developer replenisher 8 of the main body of the image-forming apparatus, yellow, magenta, cyan and black developer reservoirs 10, 20, 30, 40 were arranged, respectively. To replenishing apertures 11, 21, 31, 41 of developer reservoirs 10, 20, 30, 40, supply sections 211, 221, 231, 241 of the above-mentioned yellow, magenta, cyan and black developer containers 210, 220, 230, 240 were slidably provided, respectively. To replenishing apertures 11, 21, 31, 41, covers 12, 22, 32, 42 were slidably provided, respectively. To covers 12, 22, 32, 42, knobs 13, 23, 33, 43 were provided, respectively.

To the side of replenishing apertures 11, 21, 31, 41, boxes 314, 324, 334, 344 elongated to the sliding direction were provided, respectively. To the boxes 314, 324, 334, 344, locking members 315, 325, 335, 345 were so provided as to be movable to the direction of covers 12, 22, 32, 42, at the position corresponding to the colors of developers, respectively. The locking members 315, 325, 335, 345 were energized by leaf-springs 316, 326, 336, 346 so as to be coupled to hollows 12a, 22a, 32a, 42a formed inside covers 12, 22, 32, 42, respectively. When supply sections 211, 221, 231, 241 of yellow, magenta, cyan and black developer containers 210, 220, 230, 240 were inserted into replenishing apertures 11, 21, 31, 41, locking members 315, 325, 335, 345 were pushed by protrusions 213a, 223a, 233a, 243a and were then moved against leaf-springs 316, 326, 336, 346, so that the coupling of covers 12, 22, 32, 42 to hollows 12a,

22a, 32a, 42a could be released and covers 12, 22, 32, 42 could become slidable. As in the above-described manner, the structure was made as follows. The locking members were provided to the positions corresponding to the colors of developers and were then coupled to covers 12, 22, 32, 42 so as to control the sliding. The controls were released by inserting the supply section of a developer container containing the same color developer into replenishing apertures 11, 21, 31, 41, so that covers 12, 22, 32, 42 could be slidable.

To boxes 314, 324, 334, 344, slits 311, 321, 331, 341 were so provided as to be in the positions corresponding to locking members 315, 325, 335, 345, respectively. When the supply sections of developer containers were inserted into replenishing apertures 11, 21, 31, 41, the movements of locking members 315, 325, 335, 345 can easily be confirmed visually through the slits 311, 321, 331, 341, respectively.

To the ends to which the above-mentioned leaf-springs 316, 326, 336, 346 were fixed, contact pieces 312a, 322a, 332a, 342a were provided, respectively. To the positions facing locking members 315, 325, 335, 345, contact pieces 312b, 322b, 332b, 342b were provided, respectively. When yellow, magenta, cyan and black developer containers 210, 220, 230, 240 were inserted without fail and locking members 315, 325, 335, 345 were moved, contact piece 312a and contact piece 312b were electrified through leaf-springs 316, 326, 336, 346, so that a normal insertion could be displayed on display 4, respectively.

If yellow, magenta, cyan and black developer containers 210, 220, 230, 240 were erroneously inserted, locking members 315, 325, 335, 345 could not be moved. Therefore, contact piece 312a and contact piece 312b were not electrified, so that nothing was displayed on display 4.

Therefore, the developer supply sections of yellow, magenta, cyan and black developer containers 210, 220, 230, 240 were to be inserted into developer replenishing apertures 11, 21, 31, 41 of the developer reservoirs. However, when a developer container containing the same color developer was inserted in, the control was released by operating locking member provided to the position corresponding to the color of the developer, so that covers 12, 22, 32, 42 could become slidable and the same color developer was replenished to the corresponding developer reservoir.

If a developer reservoir containing some different color developer was inserted in, locking member was not operated. Therefore, any erroneous insertion could easily be confirmed and the sliding operation of covers 12, 22, 32, 42 of the developer replenishers could be controlled, so that the replenishments of any different color developers to the developer reservoirs could be prevented.

Figure 21:
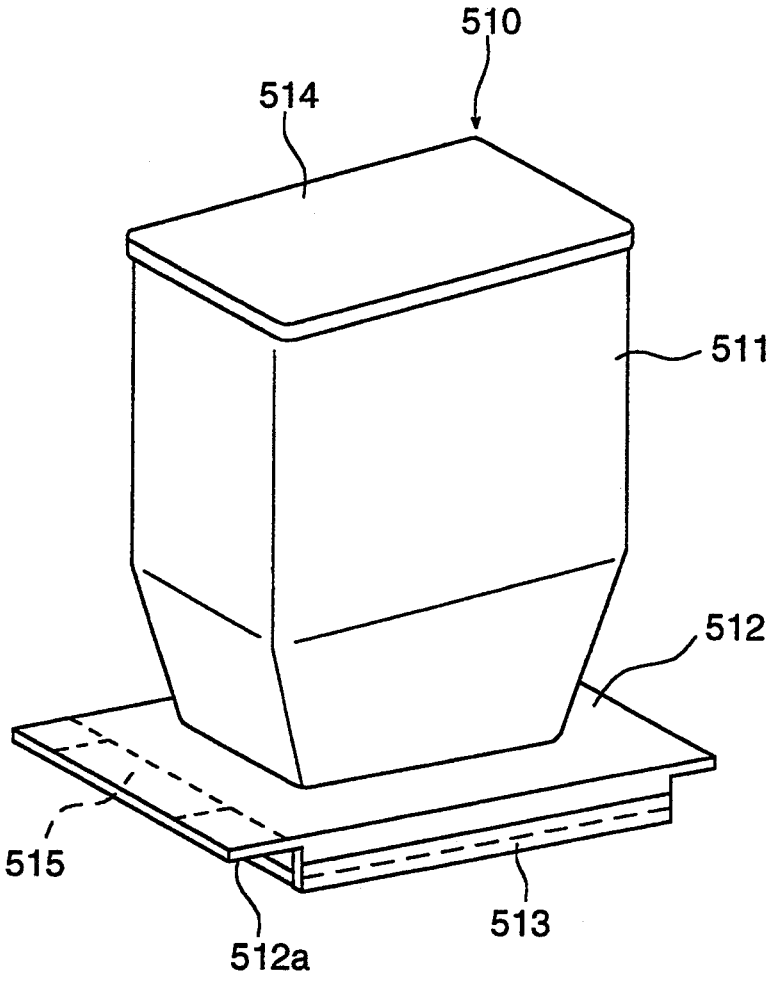
FIG. 21 is a perspective view showing the external appearance of a developer container.
Figure 22:
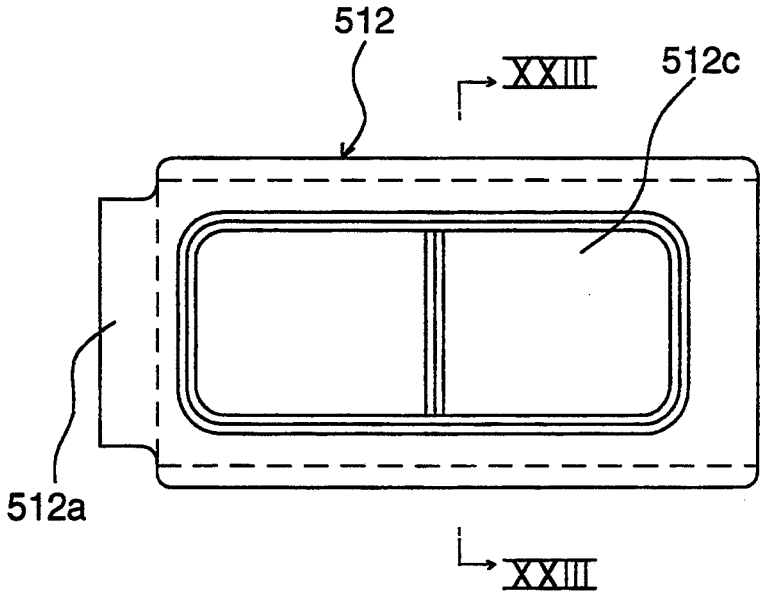
FIG. 22 is a top-plan view showing the configuration of a flange of a developer container.
Figure 23:
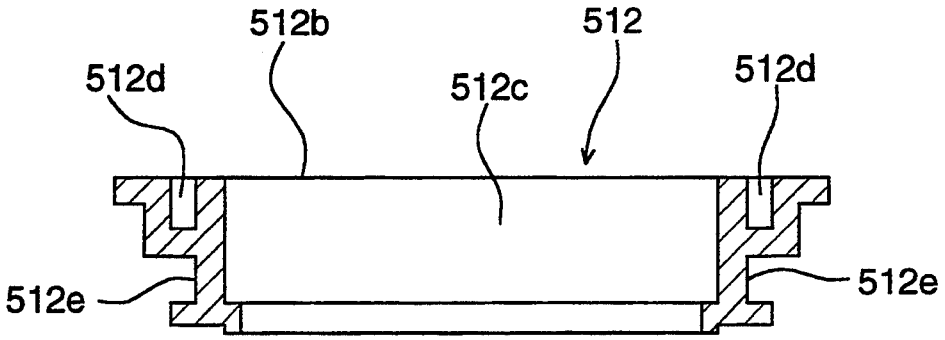
FIG. 23 is a cross-sectional view taken along the line XXIII~XXIII of FIG. 22.
Figure 24:
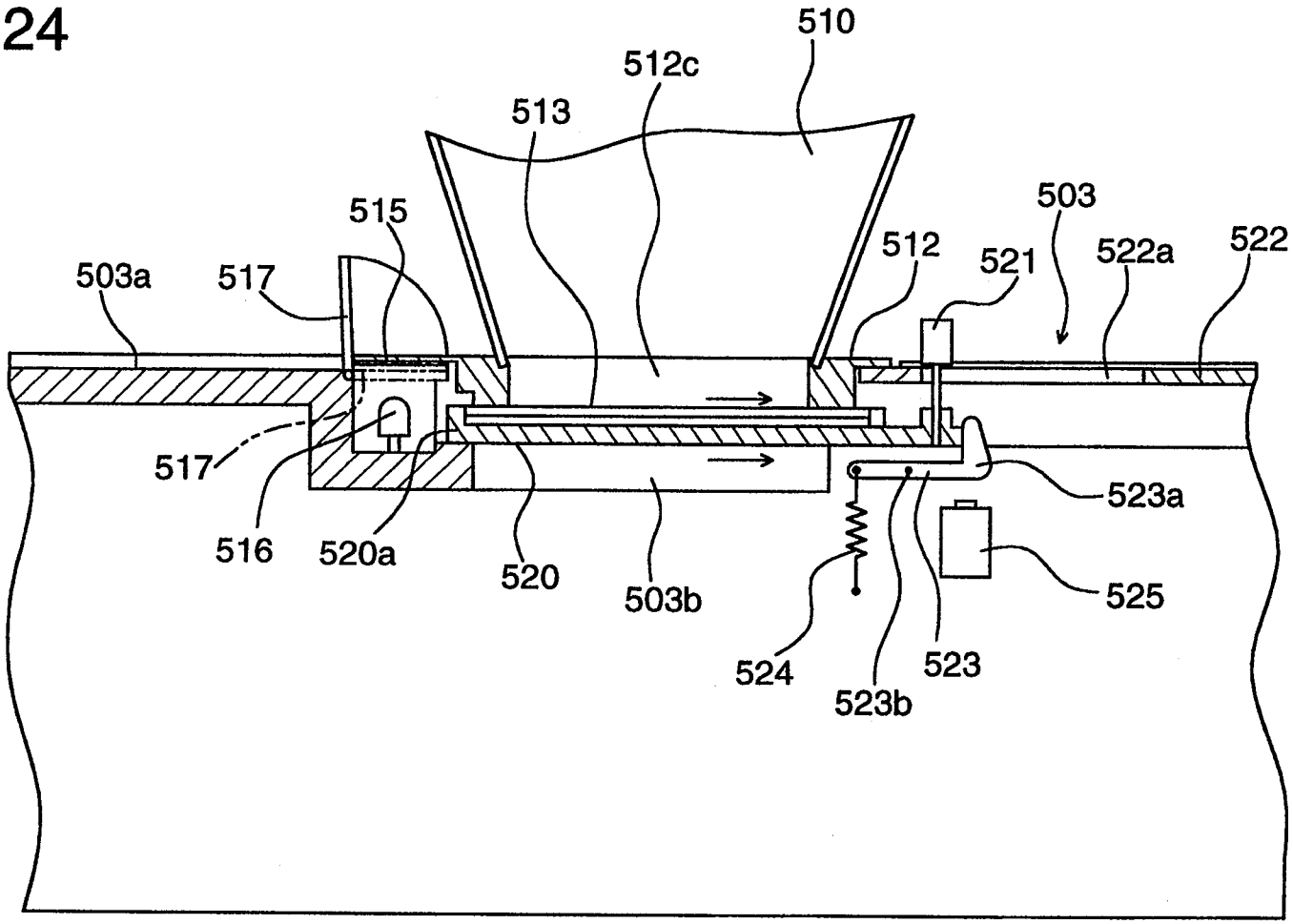
Figure 25:
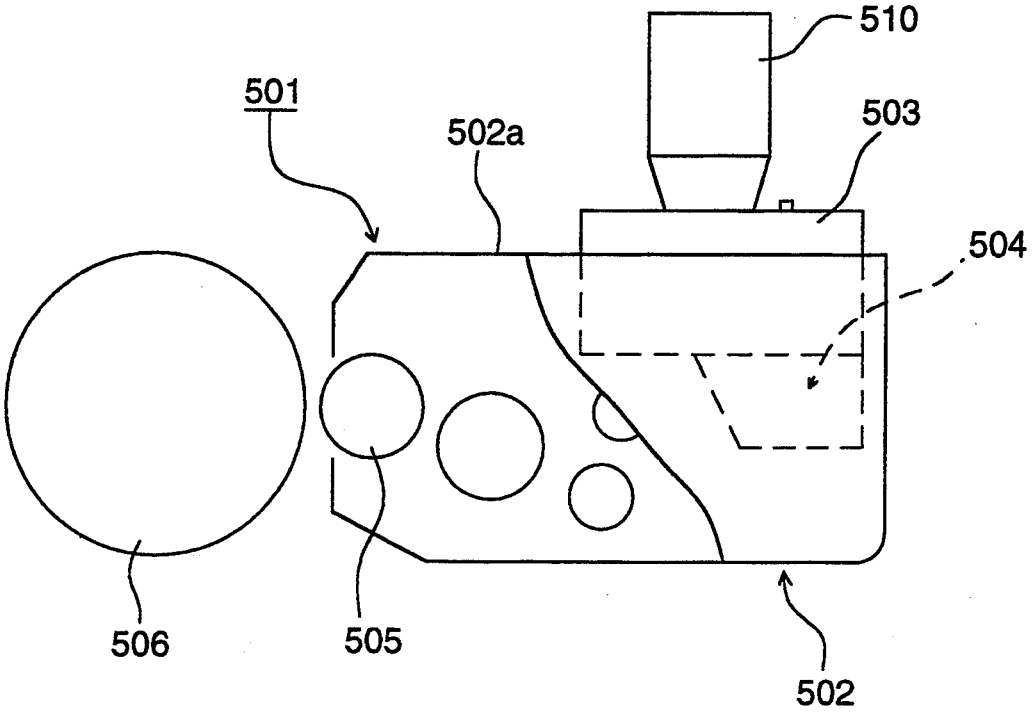
FIG. 25 is a schematic illustration showing the structure of a development section arranged to an image-forming apparatus.

Next, a further example of the invention will now be detailed below. FIG. 21 is a perspective view showing the external appearance of a developer container. FIG. 22 is a top-plan view showing the configuration of the flange of a developer container. FIG. 23 is a cross-sectional view taken along the line XXIII—XXIII of FIG. 22. FIG. 24 is a cross-sectional view showing the structure of the developer replenisher that was provided to the main body of an apparatus, as a developer container was inserted therein. FIG. 25 is a schematic illustration showing the structure of a developing section arranged to an image-forming apparatus.

As shown in FIG. 25, developing section 502 arranged in image-forming apparatus 501 was provided with developer replenisher 504 that was provided with replenishing aperture 503 to insert developer container 510 into the right upper part of main developing section body 502a. A prescribed amount of developer was supplied by the inserted developer container 510 into developing section 502. Then, the developer was transported through a fixed transport path provided into developing section 502. The developer was supplied, through developing sleeve-roller 505 provided to the left end of developing section 502, onto an electrostatic latent image formed on the circumferential surface of photoreceptor 506 adjacent to developing sleeve-roller 505 with a fixed space therebetween, so that a developed toner image could be formed on the circumferential surface of photoreceptor 506.

A developer in developing section 502 was consumed on occasion in every series of developments. Therefore, after completing a certain frequency of developments, it was so arranged as to insert another separately prepared developer container 510 therein and to replenish a developer into developing section 502, so that every uniform toner image could constantly be obtained thereby.

The above-described image-forming apparatus was provided with an electric means for discriminating a specific developer container in the state where developer containers were inserted into developer replenishers of the main body of the apparatus and with a means capable of opening and closing the covers for a developer replenisher and a specific developer container.

To be more concrete, in the above-described image-forming apparatus, a discrimination information section was provided to each developer container and, at the same time, a sensor for reading a discrimination information given from the discrimination information section was also provided to each developer replenisher of the main apparatus body, so that the covers for the developer replenishers of the main apparatus body and for the developer containers could be opened and closed by the discrimination made by the sensor. The apparatus was structured as follows.

As shown in FIG. 21, developer container 510 was comprised of vessel 511 for containing a developer, flange 512 formed into a body with vessel 511, cover 513 slidably attached to flange 512, top cover 514 for covering the upper surface of vessel 511, and bar-code 515 for discriminating a developer to be contained, the color of the developer, the destination and so forth.

Each of vessel 511, flange 512, cover 513 and top cover 514 was molded of plastics and the configuration thereof was in common, regardless of the colors of developers and the destination thereof.

As shown in FIGS. 22 and 23, flange 512 was comprised of aperture 512c having the central portion substantially bored in the rectangular form, top surface 512b shown in FIG. 23, long groove 512d provided to the outer circumference of aperture 512c to join vessel 511, and U-shaped guide grooves 512e that was made slidable by fitting sliding covers 513 in both sides of the flange in the longitudinal direction. Protruded piece 512a was provided to the position where upper surface 512b was extended, to the longitudinal direction, from the end of the left side of flange 512. Bar-code 515 was made ready to be attached to the surface opposite to a developer replenisher, after developer container 510 had contained a developer and prepared. Cover 513, which was to be attached to the lower surface of flange 512, was made of a flat-plate member provided with ribs (not shown) to both side ends in the longitudinal direction to fit in sliding groove 512*e* of flange 512. Also, cover 513 had a size large enough at least to cover the whole area of aperture 512*c* of flange 512. Further, when cover 513 was slid to a fixed position where aperture 512*c* was covered, cover 513 was so set as not to be shifted easily by clicking each other.

After vessel 511 was partly assembled by joining vessel 511 to flange 512, it was kept in stock and reserved. At this time, cover 513 was allowed to be fitted in, and it was also allowed to mold vessel 511 and flange 512 together into one body. Then, cover 513 was attached to vessel 511 attached with flange 512. A prescribed amount of a developer was contained in vessel 511 having aperture 512*c* closed by cover 513. After fitting the aforementioned top cover 514 into one body, bar-code 515 designating the color of a developer and the destination was attached to the prescribed position of protruded piece 512*a* of flange 512. Thereby, discriminated developer container 510 could be prepared. Further, a suitable protect-cover (not shown) was so fitted in to cover both cover 513 and flange 512 so that a developer contained in developer container 510 could not be spilt carelessly.

In the process for assembling developer container 510, all the common members and assembled parts were supplied and assembled, before bar-code 515 was attached. Therefore, the time and labor for storing in or out and preparing processes could greatly be saved. As described above, flange 512 was in common regardless of the colors of developers and the destinations and the dies for molding were also commonly used. It was, therefore, very convenient for improving the efficiency.

Developer container 510 prepared in the above-described manner was attached to developer replenisher 503 arranged to developing section 502 to be supplied with a developer in an amount corresponding to the consumption of the developer. As shown in FIG. 24, developer replenisher 503 was provided, with rectangular-shaped replenishing aperture 503*b*, to the neighborhood of the upper center of developer reservoir 503*a*. To the upper surface, cover 520 for opening and closing the replenishing aperture 503*b* was slidably attached in the direction of the arrow. As shown in the drawing, bent portion 520*a* erected at right angles was provided to the left end of cover 520 to couple it to the left end of cover 513 when developer container 510 was inserted in.

Under the right end of cover 520 so positioned as to cover replenishing aperture 503*b*, there provided with hook 523 that was suspended on the frame of developer reservoir 503*a* to be rotatable around fulcrum axis 523*b*. The hook 523 was provided with one end to the left end portion and the other end thereof was elastically energized counterclockwise constantly by spring 524 fixed to the frame of developer reservoir 503*a*. Cover 520 was hooked by coupling claw 523*a* provided to the right end of hook 523 to the right end surface of cover 520. To the right upper end surface of cover 520, knob 521 was fitted up into one body. The upper part of knob 521 was protruded upward to cover 522 covering the upper part of developer reservoir 503*a*. Knob 521 was so arranged as to be movable together with cover 520 to the direction of the arrow by operating it by hand. To cover 522, long hole 522*a* was so provided as not to interfere the operation range of knob 521. In the lower portion opposite to hook 523, solenoid 525 was fitted to the frame of developer reservoir 503*a*. When electrifying solenoid 525 to be magnetically excited, hook 523 was rotated clockwise against spring 524, so that it released from the coupling to cover 520.

When solenoid 525 was cut off the magnetic excitation, hook 523 was coupled again to the above-mentioned position of cover 520 by the elastic energy of spring 524.

As shown in FIG. 24, to the fixed position on the left side of replenishing aperture 503*b* of developer reservoir 503*a*, sensor 516 for reading bar-code 515 was provided oppositely to bar-code 515 when developer container 510 was attached to replenishing aperture 503*b*. When developer container 510 was not inserted in, sensor 516 was covered by sensor-cover 517 as indicated by two-dot chain line.

In developer replenisher 503 structured as above, after sensor-cover 517 thereof was opened as indicated by the solid line in FIG. 24 to expose the upper part of sensor 516 and designated developer container 510 was then inserted in through flange 512 and when developer container 510 was so detected as to be adaptable upon reading bar-code 515 by sensor 516 set to the fixed position shown in the drawing, solenoid 525 was electrified to be magnetically excited and, by the magnetic force of solenoid 525, hook 523 was rotated clockwise and the coupling to cover 520 was released free. By moving knob 521 by hand to the direction of the arrow, cover 513 of developer container 510, which was coupling to knob 521, was also moved together with cover 520, so that aperture 512*c* of flange 512 and replenishing aperture 503*b* of developer replenisher 503 were opened. Thereby, a developer contained in developer container 510 was dropped into developer replenisher 503*a* to be supplied.

The electrified magnetic excitation to solenoid 525 was cut off when cover 520 was moved to the fixed position. Therefore, hook 523 was rotated counterclockwise by spring 524 so that hook claw 523*a* was brought into pressure contact with the lower surface of cover 520.

After a developer was completely supplied from developer container 510 into developer replenisher 503, cover 520 was returned together with cover 513 to a fixed position covering replenishing aperture 503*b*. At that time, cover 520 was hooked again by hook 523.

For example, on the supposition that developer container 510 attached with any different bar-code 515 was inserted in, even if the bar-code was read by sensor 516, solenoid 525 was not electrified because the different code was not conformed to the code memorized in advance. Therefore, hook 523 remained in the state where cover 520 was hooked, so that knob 521 could not be moved. Therefore, a user could notice that developer container 510 was erroneously inserted in. When an erroneous insertion was detected by sensor 516, a user could more clearly confirm the erroneous insertion if a warning was displayed on a panel or the like of an image-forming apparatus.

In the above-described example, bar-code 515 was attached to developer container 510 so that a discrimination could be made. However, the scope of the invention shall also include not only the above-described bar-code 515, but also a means in which a detection was made by attaching separate magnetic tapes for detecting every color of developers and every destination so that any erroneous insertion could be prevented in the above-described method.

Each of all the members for structuring a developer container could have the same configurations in common, because separate bar-codes or magnetic tapes were attached to developer containers to detect the colors of developer and destinations. Therefore, the warehousing controls and assembling processes of the assembled parts of each member could be very simplified and the efficiency thereof could also be remarkably improved. It was the matter of course to completely avoid the erroneous insertion of developer containers into developer replenishers.

As described above, the cover for a developer replenisher and the cover for a specific developer container is opened and closed when the developer container is inserted into the developer replenisher and the specific developer container is inserted into the developer replenisher. It is, therefore, possible to solve the following inconvenience; as in the conventional image-forming apparatuses, a portion of the developer container containing a different color developer is inserted askew into the developer replenisher and the cover thereof is opened by coupling it to the cover for the developer container, so that the different color developer is replenished from the developer replenisher or the developer is made adhered to the surroundings of the developer replenisher. Besides, every developer container is inserted once into the developer replenishers and, therefore, the developer containers cannot be damaged even if a developer container containing a different color developer is tried to forcibly insert in.

When a specific developer container is inserted into a developer replenisher, then, both covers for the developer replenisher and for the specific developer container are opened and closed interlockwise each other. It is, therefore, possible to prevent the cover for the developer container and the surroundings thereof from making adhered thereto with a developer spouted up from the developer replenisher side.

A specific developer container is discriminated by a mechanical means operated by inserting the developer container into a developer replenisher and the cover for the developer replenisher and the cover for the specific developer container are opened and closed thereby. It is, therefore, possible to prevent any erroneous insertion by discriminating the developer container in a simple structure.

A developer container is discriminated whether it is specific one or not by a discriminating means applied with the discriminator of the developer container and, when the developer container is discriminated to be specific one, a control means is released and, both covers for the developer container and the developer replenisher can be opened and closed. It is, therefore, possible to prevent any erroneous insertion of the developer container in a simple structure and to prevent any developer leakage from the developer replenisher, because the cover for the developer replenisher cannot be opened and closed when the developer is not replenished or a developer container is erroneously inserted in.

A specific developer container is discriminated by an electric means operable in the state where the developer container is inserted into a developer replenisher and the cover for the developer replenisher and the cover for the developer container are opened and closed thereby. It is, therefore, possible to replenish a developer after the developer container can automatically be discriminated when inserting the developer container into the developer replenisher.

A discrimination information is read from the discrimination section of a developer container by a sensor provide to a developer replenisher and the cover for the developer replenisher and the cover for a specific developer container can be opened and closed upon discriminating the developer container. It is, therefore, possible to discriminate the developer container in a simple structure and then to replenish a developer.

What is claimed is:

1. An image-forming apparatus for forming a fixed image on a recording sheet by forming an electrostatic image on an image receiving drum from an original image sheet, developing said electrostatic image with a color toner for form a toner image thereon, transferring said toner image to said recording sheet, and heat fixing said toner image, said apparatus comprising;

a plurality of developer containers containing a plurality of developers for replenishment, a plurality of developer replenishing gates provided on a main body of said apparatus for receiving replenishing developer from said developer containers and for supplying developer to developing devices, wherein each of said developer containers is provided with a first cover and a first toner color indicator positioned in a position indicative of a color and type of toner contained in said developer container;

each of said developer replenishing gates being provided with a second cover and toner color checker positioned in a position indicative of a color and type of toner to be supplied from said developer container;

said developer replenishing gate being further provided with a mechanical discriminator for mechanically discriminating the color and type of toner contained in said developer container when attached to said developer replenishing gate; wherein said developer container can be attached to said developer replenishing gate, regardless of whether said developer container contains the type and color of toner corresponding to said developer replenishing gate, said developer replenishing gate further comprises a control for mechanically locking said first and second covers when positions of said color toner indicator and said toner color checker do not correspond, and when a position of said toner color indicator and said toner color checker correspond, said control mechanically releases said first and second cover for opening, and toner is fed from said developer container to said developer replenishing gate.

2. The image-forming apparatus of claim 1 wherein said first cover and said second cover are opened and closed interlockingly.

3. The image-forming apparatus of claim 1 wherein said mechanical discriminator simultaneously actuates an electric circuit to indicate whether said toner color indicator and said toner color checker correspond.

4. An image-forming apparatus for forming a fixed image on a recording sheet by electrostatically forming an electrostatic image on an image receiving drum from an original image sheet, developing said electrostatic image with a color toner to form a toner image thereon, transferring said toner image to a recording sheet, and heat fixing said toner image, said apparatus comprising;

a plurality of developer containers containing a plurality of developers for replenishment, a plurality of developer replenishing gates provided on a main body of said apparatus for receiving replenishing developer from said developer containers and for supplying developer to developing devices, wherein each of said developer containers is provided with a first cover and a first toner color indicator positioned in a position indicative of a color and type of toner contained in said developer container;

each of said developer replenishing gates being provided with a second cover and toner color checker positioned in a position indicative of a color and type of toner to be supplied from said developer container;

said developer replenishing gate being further provided with an electronic discriminator for electronically discriminating the color and type of toner contained in said developer container when attached to said developer replenishing gate; wherein said developer container can be attached to said developer replenishing gate, regardless of whether said developer container contains the type and color of toner corresponding to said developer replenishing gate, said developer replenishing gate further comprises a control for mechanically locking said first and second covers when positions of said color toner indicator and said toner color checker do not correspond, and when a position of said toner color indicator and said toner color checker correspond, said control mechanically releases said first and second cover for opening, and toner is fed from said developer container to said developer replenishing gate.

5. The image-forming apparatus of claim 4 wherein said electronic discriminator comprises an electronic discrimination information section provided on said developer container, and a sensor for reading discrimination information from said discrimination information section, said sensor being provided on said developer replenishing gate.

6. The image-forming apparatus of claim 5 wherein said sensor comprises a bar code reader, and said discrimination information section comprises a bar code.

7. The image-forming apparatus of claim 5 wherein said sensor comprises a magnetic tape reader and said discrimination information section comprises a magnetic tape.

* * * * *